United States Patent [19]

Bongiovanni

[11] 4,062,468

[45] Dec. 13, 1977

[54] FUEL STORAGE TANK INSULATING SYSTEM

[76] Inventor: John P. Bongiovanni, 19 Bates Road, Chester, Conn. 06412

[21] Appl. No.: 780,687

[22] Filed: Mar. 23, 1977

[51] Int. Cl.[2] ..... B65D 25/34; E04B 1/80

[52] U.S. Cl. ..... 220/9 A; 220/9 F; 220/15

[58] Field of Search ..... 220/9 A, 9 F, 9 LG, 220/10, 63 R, 15; 52/249

[56] References Cited

U.S. PATENT DOCUMENTS

| | | | |
|---|---|---|---|
| 602,454 | 4/1898 | Kelly | 220/9 A |
| 1,251,830 | 1/1918 | Siegfried | 220/9 A |
| 2,206,680 | 7/1940 | Sitton | 220/9 A X |
| 2,575,941 | 11/1951 | Brunnzell | 220/9 A X |
| 2,738,094 | 3/1956 | Fowler | 220/9 A |
| 2,931,211 | 4/1960 | McCullough | 220/9 A X |
| 3,054,523 | 9/1962 | Batzer et al. | 220/10 |
| 3,948,412 | 4/1976 | Bennett | 220/9 F X |

*Primary Examiner*—Stephen Marcus
*Attorney, Agent, or Firm*—McCormick, Paulding & Huber

[57] ABSTRACT

A fuel storage tank of welded steel plate design is insulated by first providing a structural layer of expanded steel mesh or lath welded to the exterior tank wall by welding washers, and then applying gobs of a cementitious mastic to hold foam heat insulating boards to discrete areas of the lath layer. An outer layer of fiberglass reinforced resin provides a durable yet pliable outer finish for the tank, and also imparts tensile strength to the resulting insulating structure.

11 Claims, 4 Drawing Figures

FUEL STORAGE TANK INSULATING SYSTEM

BACKGROUND OF THE INVENTION

Conventional fuel storage tanks are generally made up of steel plates welded together with heavier, or thicker plates at the bottom and progessively thinner plates near the top. The cylindrical tanks are sometimes 120 feet in diameter and up to 50 feet in height. A concrete or crushed stone floor supports the steel floor of the tank, and a conical roof, also of steel, is generally supported not only by the cylindrical wall, but also by joists which are supported on internal columns resting on the steel floor.

The fuel stored in these tanks may comprise heavy oil, or even asphalt, and in northern climates must be continually heated so that the oil will flow. The temperature variation from the oil inside the tank to the atmosphere outside may be between 150 to 300 Farenheit degrees, and since the steel conducts heat very efficiently, there is a need for a system to economically and efficiently insulate these tanks. The steel plates in these tanks move as much as 6 inches when the tanks are filled or emptied, so the design of a practical system for insulating these tanks has not been commercially available.

The chief aim of the present invention is to provide a system for insulating fuel storage tanks, which system is not only economical, but which is also capable of withstanding the severe environmental conditions existing in the areas where such tanks have been erected.

SUMMARY OF INVENTION

This invention relates generally to the insulating of large commercial type fuel storage tanks, and deals more particularly with a system for applying layers of structural insulatory and environmentally impervious material to an existing tank, especially to the external cylindrical portion thereof.

In carrying out the present invention sheets of expanded metal lath are welded to the steel tank by means of washers or the like, and foam boards or sheets of insulating material are bonded to the lath layer by gobs of mastic anchored to discrete areas of the lath. The foam boards are spaced slightly from the lath so that the differences in rates of thermal expansion for the steel tank and the foam boards is accommodated by the metal lath and the mastic gobs. An outer layer of resin is applied to the foam boards, and a reinforcing cloth fiber is provided in the resin to yield a tough outer skin.

A conical roof structure for the tank is similarly constructed. Sleepers may be arranged in a fan shaped pattern on the tank roof.

DETAILED DESCRIPTION

Figure 1:
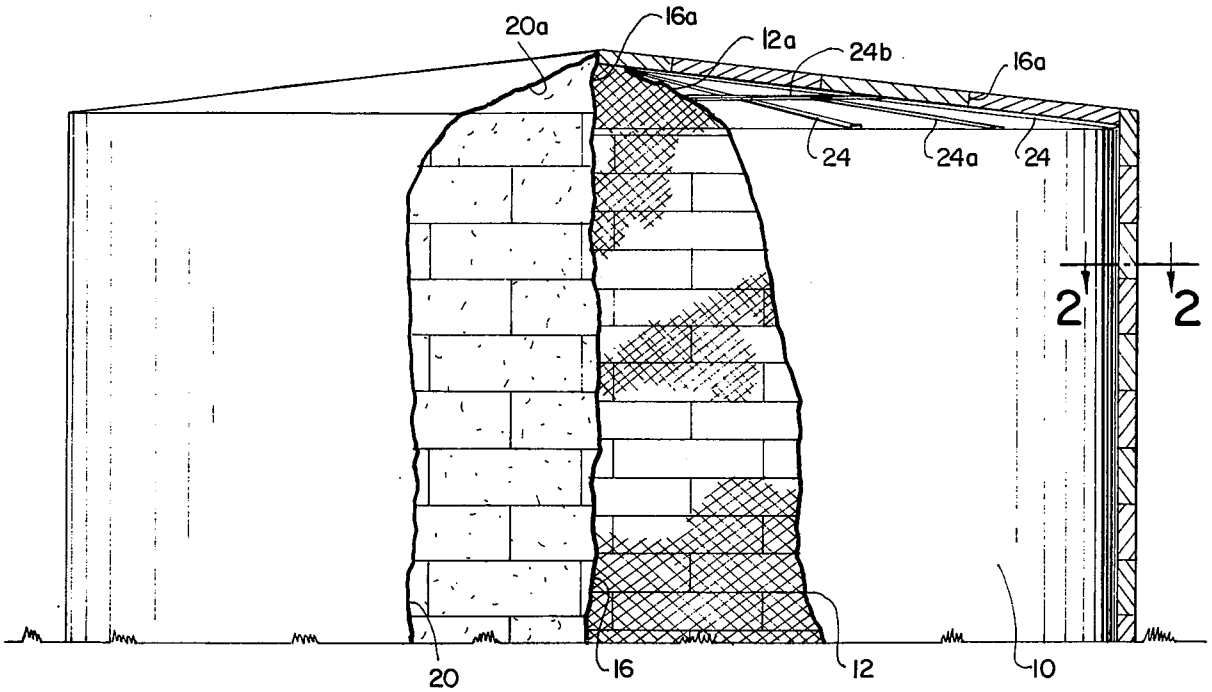
FIG. 1 is an elevational view with portions broken away showing a fuel storage tank equipped with a layered insulating system in accordance with the present invention.

Referring now to the drawings in greater detail, FIG. 1 shows a fuel storage tank of conventional construction, such a tank having a generally cylindrical configuration, with a conically shaped roof supported by joists which rest on internal columns (not shown) and by the upper edge of the side wall 10. Such tanks are generally made up of steel plates welded together, and include a steel floor which if similar construction, and generally supported on a bed of trap rock which may be provided above a concrete base or bulkhead. These tanks may be 50 to 120 feet in diameter and are usually of about 50 feet in height. The steel plate construction leads to a significant degree of deformation of the structure as the tanks are emptied and refilled. The fuel stored in these tanks must be heated so that the viscosity of the fuel can be kept within a reasonable range for pumping purposes. Although the need for insulating these tanks has been apparent for many years, the inherent flexibility of the tank structure itself has proven to be an impediment to the development of a viable system for insulating these tanks. The system to be described provides an economical solution to this dilemma, and includes a layered insulating system well adapted to absorb the strains of the cyclically stressed tank structure.

In accordance with the presently preferred embodiment of the invention an inner structural layer 12 is attached to the exterior of the tank and serves as a convenient means for securing the insulating layer, while also serving to absorb any dimensional changes of the tank structure due to thermal or mechanically induced strains.

Figure 4:
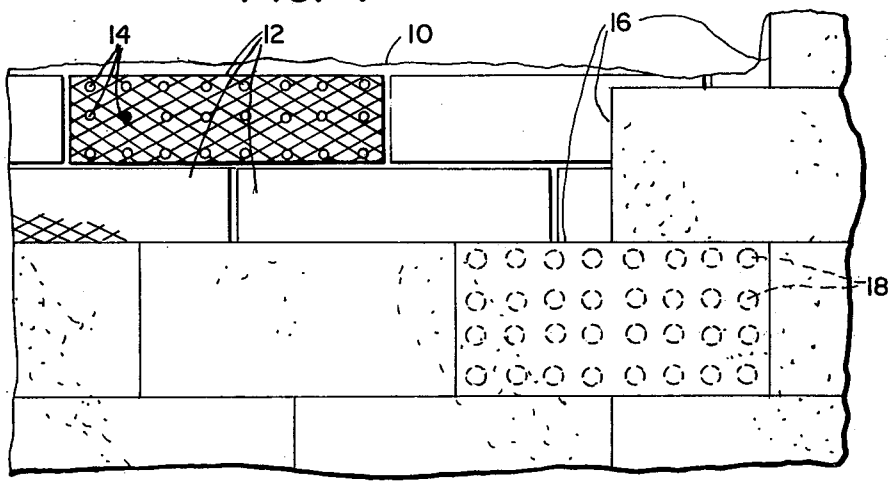
FIG. 4 is an interior view of a portion of the insulated wall without the outer layer, and with a portion of the insulating layer removed to reveal the inner layer of expanded metal lath sheets.

This inner layer 12 comprises a plurality of individual expanded metal lath sheets which are bonded to the steel tank by means of welding washers 14, 14 arranged in a pattern as suggested in FIG. 4. The expanded steel lath is free to expand and contract between the welding washers 14, 14 and this flexibility permits an additional insulating layer to be applied in such a way that the insulating material need expand and contract, or more mechanically with the steel tank 10.

The preferred form for such insulating layer 16 comprises a plurality of foam board sheets (such as STYROFOAM or PLASTIFOAM) which are bonded to discrete areas of the metal lath by means of gobs 18, 18 mastic material arranged in a pattern best shown in FIG. 4. Although expanded polystyrene foam is preferred, an expanded urethane or isocyanurate might be used where higher temperatures exist.

Figure 2:
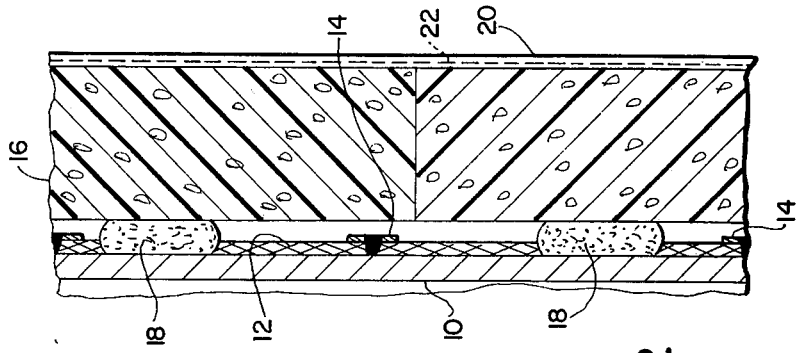
FIG. 2 is a sectional view taken generally on line 2—2 of FIG. 1 but drawn to a somewhat larger scale.

As best shown in FIG. 2, the gobs of mastic are anchored to the metal lath 12, and actually engage the steel tank 10, but these gobs 18, 18 mainly serve to anchor discrete areas of the insulating boards 16 to the lath 12 with a space provided therebetween. The mastic material preferably comprises a mix of MC 76 acrylic polymer sold by Rohm and Haas, No. 144 grade asbestos resin, No. 200 Air-O-Cel, and a conventional cement and water mix. Some defoamer may be added to the MC 76 acrylic polymer. This mastic yields a secure bond with the expanded polystyrene board material, and also provides a secure anchor, mechanically, with the expanded metal lath. Tests have shown that the bond between expanded polystyrene board and this mastic have a shear strength three to five times greater than that of the boards themselves. The mechanical joint formed between the cementitious mastic and the metal lath is such that it too is stronger in shear than the lath sheet material by a significant amount. Thus, the strains imposed by the steel tank on the insulating layer are substantially reduced by the metal lath without upsetting the physical joint provided by the vertically and horizontally spaced gobs of mastic material.

In further accordance with the tank insulating system of the present invention a protective and structurally complementary outer layer 20 is attached to the insulating layer 16, and this outer layer preferably comprises a durable resilient finish resin with a woven reinforcing layer of cloth fiber provided therein. This outer layer is bonded to the outer surfaces of all the insulating boards, and thereby holds these boards in place. The single woven glass fiber cloth 22 provides this outer layer with a high degree of tensile strength, somewhat lacking in the expanded polystyrene boards, and also provides increased impact resistance for the resinous outer layer, which outer layer can be conveniently applied in liquid form to the foam boards and again after the continuously woven glass fabric has been applied. The presently preferred method of applying both resinous coatings is by spraying a commercially available resin.

The conical top of the cylindrical storage tank 10 is also insulated, and by a layered construction similar to that described above. However, the existing conical steel top of a conventional tank is generally fabricated from metal plates which are not as thick as those used in the cylindrical side wall. Thus these top plates are generally warped and buckled. Where a true conical roof is desired, sleepers supported by shims of varying length may be installed and an inner metal lath layer **12*a* may be applied (welded or screwed) directly to the sleepers. At least some of the sleepers 24 which extend from the upper edge of the cylindrical tank wall to the apex of the tank roof. Other sleepers may be provided of shorter dimensions, as shown at 24*a*, and hoop shaped sleepers 24*b* used to join the upper ends thereof in a fan shaped pattern for supporting the inner layer 12*a*** of metal lath sheets. Batt type insulation (not shown) may be installed between sleepers to further improve the heat insulating characteristics of the overall structure.

Figure 3:
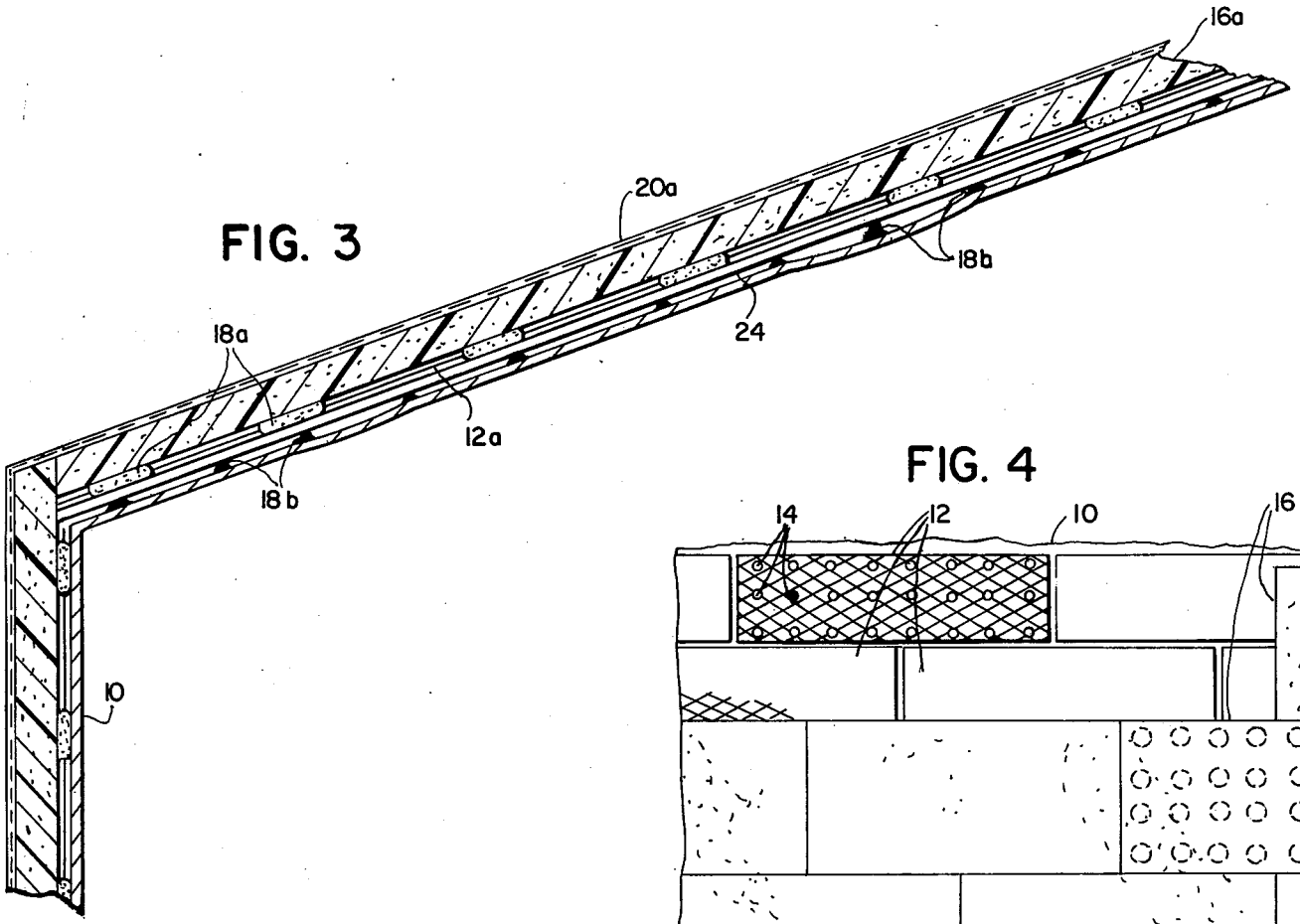
FIG. 3 is a vertical sectional view through the upper portion of the cylindrical tank shown in FIG. 1 and through a portion of the insulated roof system.

The lath sheets are held to the sleepers by welds, screws or other means (not shown) and the sleepers are also held in place by gobs, as indicated at **18*b* in FIG. 3 or clip angles. The gobs 18*a* correspond to those described above in that these gobs 18*a* anchor the foam boards 16*a*, 16*a* to the lath. Finally, the outer layer 20*a* is identical to the layer 20 described above, and has a reinforcing cloth layer (not shown) similar to the fabric 22** described above.

I claim:

1. A system for insulating a cylindrical fuel storage tank or the like, said system comprising:

a. an inner structural layer attached to the cylindrical wall of the tank said inner layer including a plurality of individual expanded metal lath sheets which are bonded to the existing exterior of the tank, b. an intermediate insulating layer attached to said inner layer, said insulating layer including a plurality of foam board sheets which are bonded to the expanded metal lath sheets with gobs of mastic material arranged in a pattern such that the gobs are spaced from one another horizontally and vertically, and c. an outer layer attached to said insulating layer, said outer layer including a resin impregnated cloth fiber reinforced coating bonded to said foam board sheets by said resin.

2. The system defined in claim 1 further characterized by a conical roof structure for the cylindrical fuel storage tank, said roof structure comprising:

d. an inner structural roof layer including a plurality of individual expanded metal lath sheets, e. an intermediate insulating roof layer which includes a plurality of foam board sheets bonded to the expanded metal lath sheets with gobs of mastic material arranged in pattern of discrete gob locations, and f. an outer layer attached to said insulating layer, said outer layer including a resin impregnated cloth fiber reinforced coating bonded to said foam board sheets by said resin.

3. The system defined in claim 1 wherein said gobs of mastic are not only anchored to said metal lath layer, but also serve as spacers to provide a space between the lath and the foam boards.

4. The system defined in claim 2 wherein said gobs of mastic are not only anchored to said metal lath layer, but also serves as spacers to provide a space between the lath and the foam boards.

5. The system defined in claim 3 wherein said mastic comprises a mix of polymer and cement.

6. The system defined in claim 5 wherein said foam board sheets comprise expanded polystyrene.

7. The system defined in claim 5 wherein said foam board sheets comprise expanded urethane.

8. The system defined in claim 5 wherein said foam board sheets comprise isocyanurate expanded material.

9. The system defined in claim 1 wherein said metal lath sheets are bonded to said cylindrical tank exterior by welding washers arranged in a pattern such that the welded attachment points are spaced from one another both horizontally and vertically.

10. The system defined in claim 3 wherein said metal lath sheets are bonded to said cylindrical tank exterior by welding washers arranged in a pattern such that the welded attachment points are spaced from one another both horizontally and vertically.

11. The system defined in claim 5 wherein said metal lath sheets are bonded to said cylindrical tank exterior by welding washers arranged in a pattern such that the welded attachment points are spaced from one another both horizontally and vertically.

* * * * *